United States Patent [19]

Galetta

[11] Patent Number: 4,514,915

[45] Date of Patent: May 7, 1985

[54] COMBINATION BOOT AND LOCKABLE STORAGE MEANS

[76] Inventor: Nicholas J. Galetta, 1 Blossom Terrace, Larchmont, N.Y. 10538

[21] Appl. No.: 447,207

[22] Filed: Dec. 6, 1982

Related U.S. Application Data

[63] Continuation-in-part of Ser. No. 353,566, Apr. 16, 1982, abandoned.

[51] Int. Cl.[3] ..... A43B 3/16

[52] U.S. Cl. ..... 36/1; 36/117; 36/122; 36/7.1 R; 70/68

[58] Field of Search ..... 70/68, 59, 62, 64; 36/1, 117, 122, 7.1 R; D3/44, 66

[56] References Cited

U.S. PATENT DOCUMENTS

| | | | |
|---|---|---|---|
| 1,776,983 | 9/1930 | Rotherham | 36/7.1 R |
| 1,819,449 | 8/1931 | Walrath | 70/68 |
| 2,112,795 | 3/1938 | Strayer | 70/68 |
| 2,115,993 | 5/1938 | Kranhold | 70/68 |
| 2,310,627 | 2/1943 | Greene | 70/68 |
| 2,569,076 | 9/1951 | Schaye | 70/68 |
| 2,578,035 | 12/1951 | Bashover | 70/68 |
| 3,041,743 | 7/1962 | Monsma | 36/1 |
| 3,177,596 | 4/1965 | Siger | 36/7.1 R |
| 3,531,955 | 10/1970 | Taylor | 70/59 |
| 4,081,882 | 3/1978 | Toepelt et al. | 70/68 |

FOREIGN PATENT DOCUMENTS

| | | | |
|---|---|---|---|
| 1222493 | 6/1960 | France | 36/7.1 R |
| 413825 | 7/1934 | United Kingdom | 70/68 |

OTHER PUBLICATIONS

*Earnshaw's Infants-Girls-Boys Wear Review* Jan. 1978, D3/66.

*Primary Examiner*—Henry S. Jaudon
*Assistant Examiner*—Mary A. Ellis

[57] ABSTRACT

A combination boot and lockable storage means. The combination comprises a boot having an opening therein for insertion of a foot. A slide closure means is provided which is attached to the sides of the opening for closing the opening. A securing means is provided for securing the slide of the fastener to the boot when the closure means is closed. A pendant means cooperatively engages the securing means for suspending the boot from a secure location by a cable means and locking the securing means. The boot is useful, for example, in a skiing environment wherein one wears the boot to the ski location, removes the boots, stores valuables therein and, then closes the opening in the boot and secures and locks the boot by the cable means to a secure location.

3 Claims, 4 Drawing Figures

FIG. 2
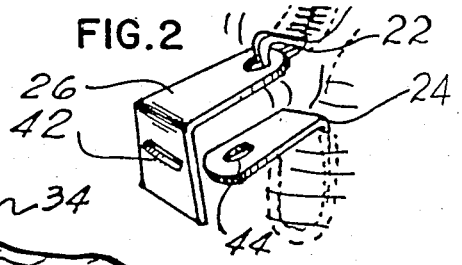
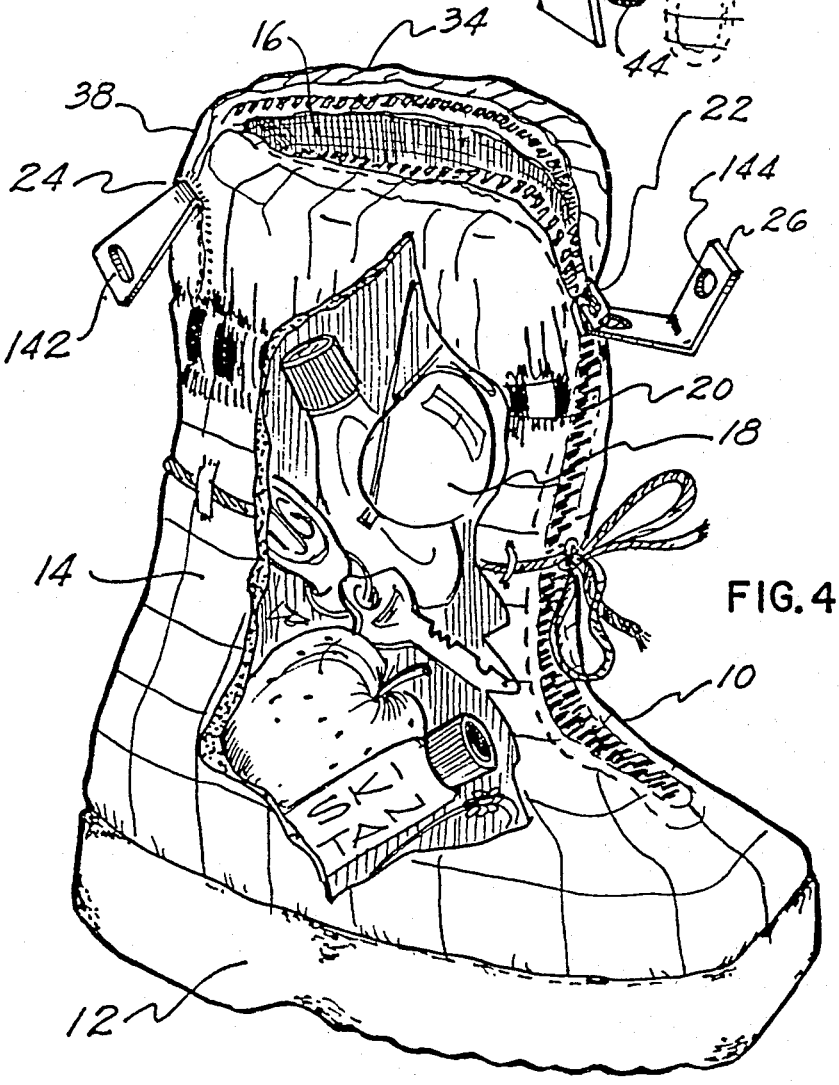
FIG. 4

COMBINATION BOOT AND LOCKABLE STORAGE MEANS

RELATED DISCLOSURE DOCUMENT AND APPLICATION

This invention is described in Disclosure Document No. 103,233 filed Oct. 1, 1981. This application is a continuation-in-part of U.S. Ser. No. 06/353,566 filed Apr. 16, 1982, now abandoned. The entire disclosure document and application are incorporated herein by reference.

BACKGROUND OF THE INVENTION

1. Field of the Invention

This invention relates to boots, and more particularly to a combination boot and lockable storage means which is particularly useful for storing and locking items therein while skiing.

2. Prior Art

Typically, when one wishes to go skiing, non-ski boots are worn to the specific location, e.g. locker rooms, ski lodge, etc. removed, the boots stored in a safe location, typically a locker along with other belongings that would not be useful while skiing. It has been found by many skiers, particularly those living near populated areas (for example in the northeastern U.S.) that when they reach the area to change from their non-ski boots to their ski boots and other skiing attire, that there are no safe locations, e.g. lockers, to lock and secure their belongings or boots. Thus they are faced with the situation of taking a chance and leaving their belongings unsecured to be misplaced or taken by other persons. Wearing their ski boots is an option which might overcome this difficulty but, such is not too desirable because it is tiring on the feet, cumbersome, etc.

Thus it is highly desirable to overcome this problem.

Several type bags and/or boots or shoes are known in the art, although they are not conducive to solving this particular problem, see for example the following U.S. patents:

DES. U.S. Pat. No. 118,430 to Doree;

DES. U.S. Pat. No. 165,540 to Neal;

DES. U.S. Pat. No. 251,574 to Molinari et al;

DES. U.S. Pat. No. 251,575 to Molinari et al; and 3,018,570 to Bliese.

None of these aforementioned references describe a boot which solves the aforementioned problem. Doree, Neal and the Molinari et al patent are directed to pocket books and not to boots or shoes. Bliese is directed to a combined shoe and purse which is unsuitable for a skiing situation and storing the items typically required to be stored in such a situation. Additionally, Bliese as well as all the other aforementioned references can be easily taken by one so desiring, i.e. there is no place to secure the item to a secure location.

OBJECTS AND SUMMARY OF THE INVENTION

It is an object of this invention to provide a combined boot and lockable storage means suitable for storing items therein and then securing the boots to a suitable location by means of a cable means.

It is a further object of this invention to provide a combination boot and lockable storage means wherein the closure means provided on the boot not only closes the storage area for such a boot but is useful in securing the boot to the person while wearing it.

The foregoing objects are achieved by a combination boot and lockable storage means. The combination comprises a boot having an opening therein for insertion of a foot into the boot. A slide closure means is provided which is attached to the sides of the opening for closing the opening. A securing means is provided for securing the slide of the fastener to the boot when the closure means is closed. A pendant means cooperatively engages the securing means for suspending the boot from a secure location by a cable means and locking the securing means. The boot is particularly useful in conjunction with skiing wherein one wears the boot to the ski location, removes the boots, stores valuables therein, then closes the opening in the boot and secures and locks the boot by the cable means which is attached to a secure location.

BRIEF DESCRIPTION OF THE FIGURES

FIG. 2 is a detailed perspective view of the securing means used on the boots depicted in FIG. 1;

FIG. 4 is a partial cross sectional view of another embodiment of the boot of this invention.

DETAILED DESCRIPTION OF THE INVENTION

Figure 1:
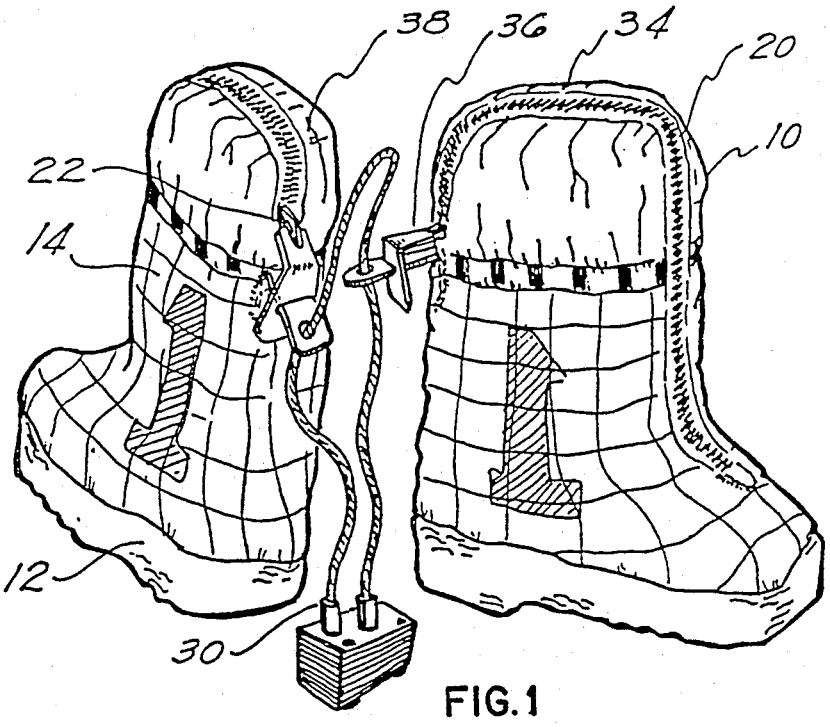
FIG. 1 is a perspective view of an embodiment of the combination boot and lockable storage means of this invention.

Referring to FIGS. 1 through 4, the combination boot and lockable storage means, generally designated (10) is of a boot shape well known in the art. The boots (10) depicted are high top boots, wherein the sides (14) are made of, for example, a nylon quilted material which extends to an area above the ankles of the wearer. Such boots provide comfort and the necessary water repellancy required in a skiing environment. The boot also has a sole (12), preferably made of a non-slip water repellant material.

The boot is provided with an opening thereto (16). The opening is depicted more clearly in FIG. 4 in its open position and in FIGS. 1–3 in its closed position. This opening (16) is useful for the insertion of the foot of the wearer into the boot (10) and also serves for inserting items (FIGS. 4–18) to be stored in the boot (10). A slide fastener, i.e. zipper, closure means (20) is attached to the sides (14) of the boot (10). The slide fastener (20) is provided with a slide (22) which is used to open and close the fastener (20).

Generally, attached to the slide (22) is a securing means, generally designated (24), for securing the slide (22) of the fastener to an area of the boot, preferably the top-rear area (38), when the zipper (20) is closed. A pendant means, generally designated (26), cooperatively engages the securing means (24). The pendant means (26) suspends the boot (10) from a secure location (28) (as shown in FIG. 3) such as a fence post, locker handle, by a cable means (30) and locks the securing means (24).

More specifically, the opening (16) and fastener means (20) extend to the front of the boot (10). This is particularly useful because not only is the zipper (20) used to close the opening (16) in the top (34) of the boot but is may also be used to snug the sides (14) of the boot (10) around the ankle of the wearer.

Figure 3:
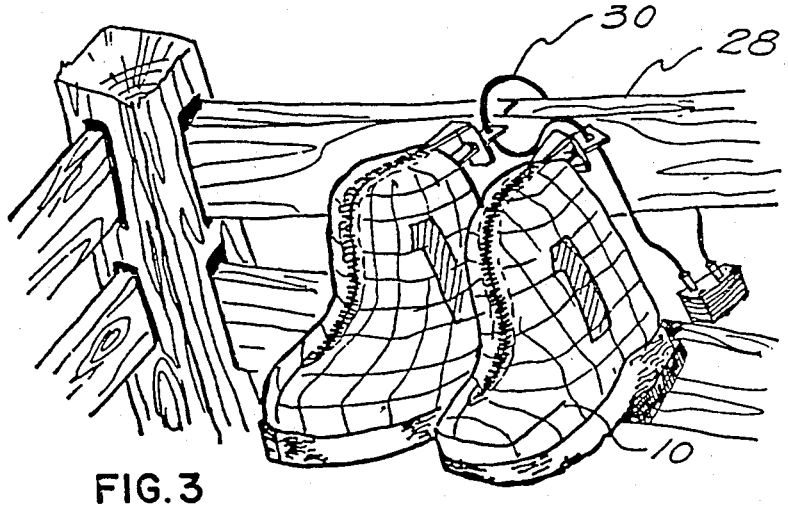
FIG. 3 is a perspective view of the boots secured to a secure location.

The Figures depict two embodiments of the securing means (24) and pendant means (26) of this invention, i.e. FIGS. 1–3 and 4. Both embodiments have a slide extension member (36) having one end attached to the slide (22) of the zipper (20). Preferably, the slide extension member (36) extends across the top (34) of the boot (10) and down the rear (38) of the boot (10). A boot member (40) is provided which consists of an elongated member having one end mounted to the rear (38) of the boot (10). Generally, one member, either the slide extension member (36) or the boot member (40) has an opening therein adapted for the passage of the other member therethrough. In FIG. 2 this opening is depicted as (42) and in FIG. 4 element (142). The other member, i.e. the slide extension member (26) or boot member (40), has another opening therein, depicted as (44 and 144) in FIGS. 2 and 4 respectively, located near the end of the member through which the cable means (20) can be passed. When the cable means (30) is passed through opening 44, 144 it prevents the passage of the other member through opening (42, 142). Thus, as depicted in FIGS. 1–3 opening (42) is in the slide extension member (36) and cable opening (44) is in the boot member (40). FIG. 4 opening (142) is in boot member (40) and cable opening (144) in slide extension member (36).

Thus a skier can wear boots (10) for example, from a parking lot, to a ski slope and upon arriving remove the boots from his feet, fill the boot with various items that require storage that he does not want to take on the slopes, such as a camera, food, cosmetics, etc. close sipper (20) and then place for example, the securing member (24) through the opening (42) in slide extension member (42) and then pass a cable means (30) through cable opening (44) to lock the boots together and lock the zippers (20) so that openings (16) cannot be opened. The boots (10) may be secured to a secure location, such as a fence (28) as depicted in FIG. 3. Likewise, as depicted in FIG. 4, the slide extension member (36) may be slipped through the opening (142) in the securing member (24) and the cable means (30) passed through cable opening (144) in the slide extension member (36), to thereby lock the slide extension member to the securing member.

The combination boot and lockable storage means of this invention may also be provided with novel colors or silk screen designs thereon so that they may be easily spotted.

By the use of the term "boot" as used herein it is meant to include, broadly, not only conventional boots but also shoes which may be provided with an opening therein through which the foot is inserted and a means for closing the opening by a slide fastener means. The boot may also be worn to school, ice skating rink, etc.

By the use of the term "cable means" it is meant to include, broadly, locking cables well known in the art, and large locks capable of performing the same function.

The foregoing is considered as illustrative only of the principles of this invention. Since numerous modifications and changes will readily occur to those skilled in the art, it is not desired to limit the invention to the exact construction and operation shown and described, and accordingly all suitable modifications and equivalance may be resorted to, falling within the scope of the appended claims.

What is claimed is:

1. A combination boot and lockable storage means comprising:

a boot having an opening therein for insertion of a foot into the boot, said opening extending from the rear of the boot along the top of the boot to the front of the boot;

a slide fastener including closure means having a pendant member, attached to the sides of the opening along its entire length for closing the opening around an ankle of a foot when inserted therein and completely closing the opening when the foot is removed therefrom;

a slide extension member having one end attached to the top rear area of the boot;

a first opening provided in the other end of said pendant member adapted for passage therethrough of the slide extension member for securing the members together when the closure means completely closes the opening, the extension member having an opening therethrough at its other end adapted to received cable means to maintain the pendant means in a locked position and provide means to suspend the boot from and lock the boot to, a secure location.

2. The combination boot and lockable storage means of claim 1, wherein the first opening is in the securing member and the second opening is in the slide extension member.

3. The combination boot and lockable storage means of claim 1, wherein the first opening is in the slide extension and the second opening is in the securing member.

* * * * *